US010607537B2

(12) United States Patent
Chaji

(10) Patent No.: US 10,607,537 B2
(45) **Date of Patent: *Mar. 31, 2020**

(54) SYSTEMS AND METHODS OF OPTICAL FEEDBACK

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/390,324

(22) Filed: Apr. 22, 2019

(65) Prior Publication Data

US 2019/0244565 A1 Aug. 8, 2019

Related U.S. Application Data

(63) Continuation of application No. 15/146,010, filed on May 4, 2016, now Pat. No. 10,311,780.

(30) Foreign Application Priority Data

May 4, 2015 (CA) ..... 2889870

(51) Int. Cl.
*G09G 3/3233* (2016.01)
*G09G 3/3258* (2016.01)
*G09G 3/3225* (2016.01)

(52) U.S. Cl.
CPC ..... *G09G 3/3225* (2013.01); *G09G 2360/147* (2013.01)

(58) Field of Classification Search
CPC ... G09G 2300/0819; G09G 2320/0242; G09G 2320/043; G09G 2320/045; G09G 2320/0295; G09G 2320/029; G09G 2330/10; G09G 2320/0613
See application file for complete search history.

(56) References Cited

U.S. PATENT DOCUMENTS

2005/0204219 A1* 9/2005 Taguchi ..... G09G 3/006 714/724
2007/0115440 A1* 5/2007 Wiklof ..... G03B 21/14 353/69
2010/0231763 A1* 9/2010 Deschamp ..... H04N 5/3675 348/246
2011/0234644 A1* 9/2011 Park ..... G09G 3/2003 345/690
2013/0038761 A1* 2/2013 Tanaka ..... H04N 5/35563 348/242
2016/0006960 A1* 1/2016 Takahashi ..... H04N 5/367 348/246

* cited by examiner

*Primary Examiner* — Lixi C Simpson
(74) *Attorney, Agent, or Firm* — Stratford Managers Corporation

(57) ABSTRACT

What is disclosed are systems and methods of optical feedback for pixel identification, evaluation, and calibration for active matrix light emitting diode device (AMOLED) and other emissive displays. Optical feedback is utilized to calibrate pixel whose output luminance exceeds a threshold difference from a reference value, and may include the use of sparse pixel activation to ensure pixel identification and luminance measurement, as well as a coarse calibration procedure for programming the starting calibration data for a fine calibration stage.

20 Claims, 8 Drawing Sheets

SYSTEMS AND METHODS OF OPTICAL FEEDBACK

CROSS-REFERENCE TO RELATED APPLICATION(S)

This application is a continuation of U.S. patent application Ser. No. 15/146,010, filed May 4, 2016, now allowed, which claims priority to Canadian Application No. 2,889,870, filed May 4, 2015, which is hereby incorporated by reference herein in its entirety.

FIELD OF THE INVENTION

The present disclosure relates to optically measuring and calibrating light emissive visual display technology, and particularly to optical feedback systems and methods for pixel identification, evaluation, and calibration for active matrix light emitting diode device (AMOLED) and other emissive displays.

BRIEF SUMMARY

According to a first aspect there is provided an optical feedback method for calibrating an emissive display system having pixels, each pixel having a light-emitting device, the method comprising: iteratively performing a calibration loop until a number of pixels of the display determined to be uncalibrated is less than a threshold number of pixels, the calibration loop comprising: measuring the luminance of pixels of the display generating luminance measurements for each pixel; comparing luminance measurements for the pixels with reference values generating a difference value for each pixel measured; determining for each pixel whether the difference value exceeds a difference threshold, and for pixels having a difference value which does not exceed the difference threshold determining the pixel to be calibrated and storing currently used calibration data for the pixel as final calibration data for the pixel, and for pixels having a difference value which exceeds the difference threshold determining the pixel to be uncalibrated and adjusting the calibration data for the pixel with use of the luminance measurement for the pixel and the previous calibration data for the pixel; and programming each pixel whose calibration data was adjusted with the adjusted calibration data.

In some embodiments, measuring the luminance of pixels of the display comprises identifying the pixels of the display comprising: activating at least one pixel of the display for luminance measurement; generating a luminance measurement image of the pixels of the display after activating the at least one pixel; identifying pixels of the display from the variation in luminance in the luminance measurement image; and extracting luminance data for each pixel identified at a position within the luminance measurement image with use of the luminance data along at least one luminance profile passing through the position within the luminance measurement image to generate said luminance measurement for said pixel.

In some embodiments, activating the at least one pixel of the display comprises activating a sparse pixel pattern wherein between any two pixels activated for luminance measurement there is at least on pixel which is inactive, thereby providing luminance measurement data corresponding to a black area between the two pixels along the at least one luminance profile.

In some embodiments, wherein activating the number of pixels of the display comprises activating a multichannel sparse pixel pattern wherein more than one channel of pixels is activated simultaneously and between any two pixels activated of any channel for luminance measurement there is at least on pixel of that channel which is inactive, thereby providing a luminance measurement data corresponding to a black area of that channel between the two pixels along the at least one luminance profile.

Some embodiments further provide for identifying defective pixels unresponsive to changes in calibration data for the defective pixels; correcting the luminance measurement image after generated for anomalies; and calibrating an optical sensor used for measuring the luminance of pixels of the display prior to measuring the luminance of pixels of the display.

Some embodiments further provide for prior to iteratively performing the calibration loop: programming each of the pixels of the display with at least two unique values; measuring the luminance of the pixels corresponding to each programmed unique value, generating coarse input-output characteristics for each pixel; generating calibration data for each pixel based on the coarse input-output characteristics for each pixel; and programming each of the pixels of the display with the calibration data for the pixel.

According to another aspect there is provided an optical feedback system for calibrating an emissive display system having pixels, each pixel having a light-emitting device, the system comprising: a display panel comprising said pixels; an optical sensor operative to measure luminance of pixels of the display panel; optical feedback processing coupled to the optical sensor; and a controller of the emissive display system coupled to said optical feedback processing and for iteratively controlling a calibration loop until a number of pixels of the display panel determined to be uncalibrated is less than a threshold number of pixels, iteratively controlling the calibration loop comprising: controlling the optical sensor and the optical feedback processing to measure the luminance of pixels of the display panel generating luminance measurements for each pixel; controlling the optical feedback processing to compare luminance measurements for the pixels with reference values generating a difference value for each pixel measured; controlling the optical feedback processing to determine for each pixel whether the difference value exceeds a difference threshold, and for pixels having a difference value which does not exceed the difference threshold to determine the pixel to be calibrated and store currently used calibration data for the pixel as final calibration data for the pixel, and for pixels having a difference value which exceeds the difference threshold to determine the pixel to be uncalibrated and adjust the calibration data for the pixel with use of the luminance measurement for the pixel and the previous calibration data for the pixel; and programming each pixel whose calibration data was adjusted with the adjusted calibration data.

In some embodiments, the controller's controlling of the optical sensor and the optical feedback processing to measure the luminance of pixels of the display panel comprises controlling identification of the pixels of the display panel comprising: activating at least one pixel of the display panel for luminance measurement; controlling the optical sensor and optical feedback processing to generate a luminance measurement image of the pixels of the display panel after activating the at least one pixel; controlling the optical feedback processing to identify pixels of the display panel from the variation in luminance in the luminance measurement image; and controlling the optical feedback processing to extract luminance data for each pixel identified at a position within the luminance measurement image with use of the luminance data along at least one luminance profile passing through the position within the luminance measurement image to generate said luminance measurement for said pixel.

In some embodiments, the controller's activating the at least one pixel of the display comprises activating a sparse pixel pattern wherein between any two pixels activated for luminance measurement there is at least on pixel which is inactive, thereby providing luminance measurement data corresponding to a black area between the two pixels along the at least one luminance profile.

In some embodiments, the controller's activating the number of pixels of the display comprises activating a multichannel sparse pixel pattern wherein more than one channel of pixels is activated simultaneously and between any two pixels activated of any channel for luminance measurement there is at least on pixel of that channel which is inactive, thereby providing a luminance measurement data corresponding to a black area of that channel between the two pixels along the at least one luminance profile.

In some embodiments, the optical sensor is calibrated prior being used for measuring the luminance of pixels of the display, and wherein the controller is further for: controlling the optical feedback processing to identify defective pixels unresponsive to changes in calibration data for the defective pixels; and controlling the optical feedback processing to correct the luminance measurement image after generated for anomalies.

In some embodiments, the controller is further for prior to iteratively performing the calibration loop: programming each of the pixels of the display with at least two unique values; controlling the optical sensor and the optical feedback processing to measure the luminance of the pixels corresponding to each programmed unique value, to generate coarse input-output characteristics for each pixel; generating calibration data for each pixel based on the coarse input-output characteristics for each pixel; and programming each of the pixels of the display with the calibration data for the pixel.

The foregoing and additional aspects and embodiments of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the disclosure will become apparent upon reading the following detailed description and upon reference to the drawings.

Figure 1:
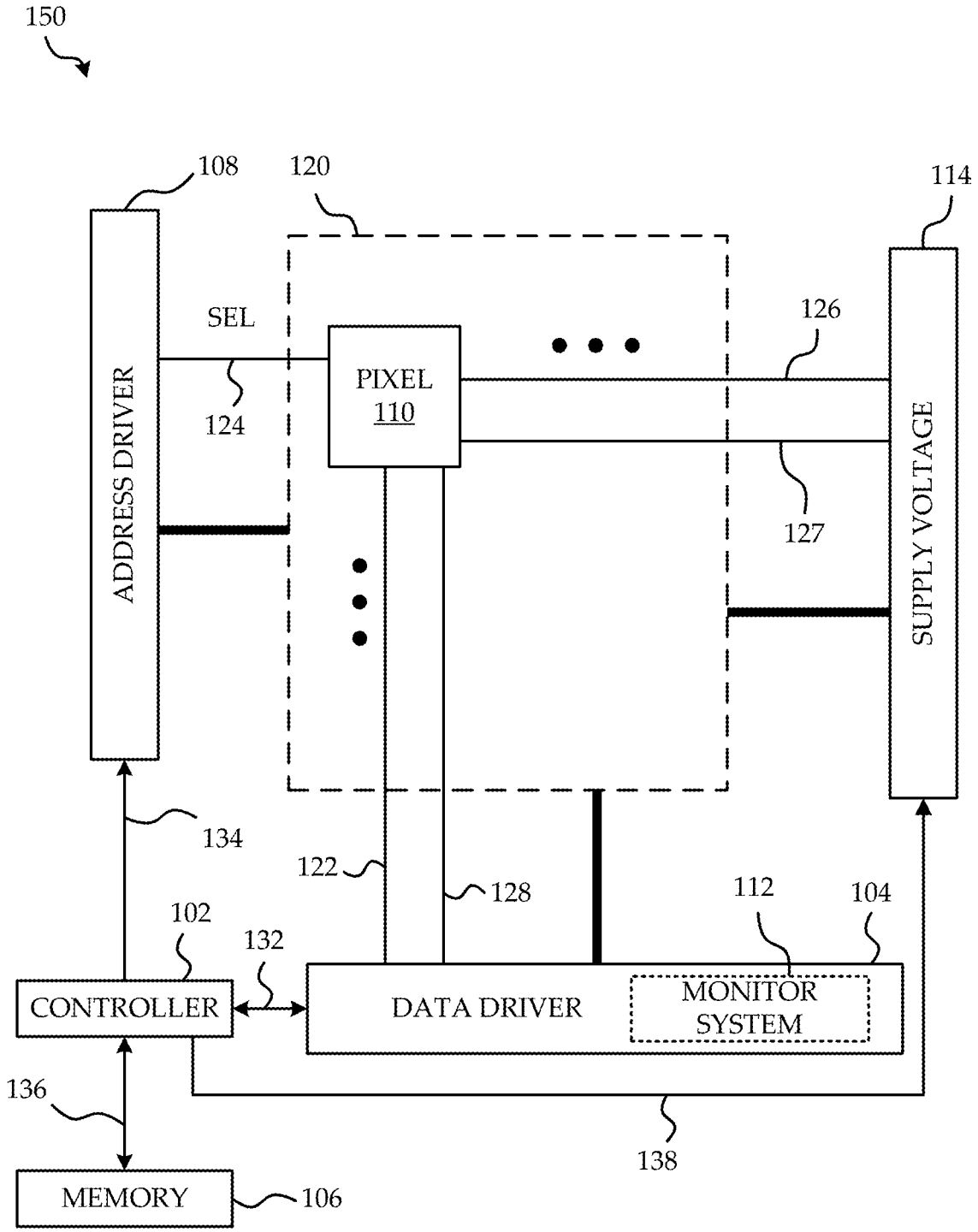
FIG. 1 illustrates an example display system which participates in and whose pixels are to be measured and calibrated by the optical feedback systems and methods disclosed.

While the present disclosure is susceptible to various modifications and alternative forms, specific embodiments or implementations have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of an invention as defined by the appended claims.

DETAILED DESCRIPTION

Many modern display technologies suffer from defects, variations, and non-uniformities, from the moment of fabrication, and can suffer further from aging and deterioration over the operational lifetime of the display, which result in the production of images which deviate from those which are intended. Optical feedback systems and methods can be used, either during fabrication or after a display has been put into use, to measure and calibrate pixels (and sub-pixels) whose output luminance varies from the expected luminance. One challenge with optical feedback systems is how to correct for errors in pixel luminance at the pixel level rather than at the display level or at the level of multi-pixel subareas areas of the display. Also, if the non-uniformity in the system is high, each pixel will have a significantly different point in the input-output response curve which will result in a significantly different propagation error in the extracted input-output curve based on the measurement points. For example, when similar inputs are applied to pixels with significantly different input-output curves, such as one pixel having a very week input-output curve (e.g. having a very high threshold voltage or a very low gain factor) and another pixel with a very strong input-output curve (e.g. having a very small threshold voltage or a very high gain factor), significantly different outputs are created. In some cases a weak pixel may be even remain "off" for some of the input. In such cases of high non-uniformity, the noise or error in the measurement can have a significantly different effect on each pixel since the two measured output values are so far apart. Thus, the error in extracted input-output curves as the result of measurement can be significantly different. The systems and methods disclosed below address these two issues.

While the embodiments described herein will be in the context of AMOLED displays it should be understood that the optical feedback systems and methods described herein are applicable to any other display comprising pixels, including but not limited to light emitting diode displays (LED), electroluminescent displays (ELD), organic light emitting diode displays (OLED), plasma display panels (PSP), among other displays.

It should be understood that the embodiments described herein pertain to systems and methods of optical feedback and compensation and do not limit the display technology underlying their operation and the operation of the displays in which they are implemented. The systems and methods described herein are applicable to any number of various types and implementations of various visual display technologies.

FIG. 1 is a diagram of an example display system 150 implementing the methods described further below in conjunction with an arrangement with an optical sensor or array and optical feedback processing. The display system 150 includes a display panel 120, an address driver 108, a data driver 104, a controller 102, and a memory storage 106.

The display panel 120 includes an array of pixels 110 (only one explicitly shown) arranged in rows and columns. Each of the pixels 110 is individually programmable to emit light with individually programmable luminance values. The controller 102 receives digital data indicative of information to be displayed on the display panel 120. The controller 102 sends signals 132 to the data driver 104 and scheduling signals 134 to the address driver 108 to drive the pixels 110 in the display panel 120 to display the information indicated. The plurality of pixels 110 of the display panel 120 thus comprise a display array or display screen adapted to dynamically display information according to the input digital data received by the controller 102. The display screen and various subsets of its pixels define "display areas" which may be used for monitoring and managing display brightness. The display screen can display images and streams of video information from data received by the controller 102. The supply voltage 114 provides a constant power voltage or can serve as an adjustable voltage supply that is controlled by signals from the controller 102. The display system 150 can also incorporate features from a current source or sink (not shown) to provide biasing currents to the pixels 110 in the display panel 120 to thereby decrease programming time for the pixels 110.

For illustrative purposes, only one pixel 110 is explicitly shown in the display system 150 in FIG. 1. It is understood that the display system 150 is implemented with a display screen that includes an array of a plurality of pixels, such as the pixel 110, and that the display screen is not limited to a particular number of rows and columns of pixels. For example, the display system 150 can be implemented with a display screen with a number of rows and columns of pixels commonly available in displays for mobile devices, monitor-based devices, and/or projection-devices. In a multichannel or color display, a number of different types of pixels, each responsible for reproducing color of a particular channel or color such as red, green, or blue, will be present in the display. Pixels of this kind may also be referred to as "subpixels" as a group of them collectively provide a desired color at a particular row and column of the display, which group of subpixels may collectively also be referred to as a "pixel".

The pixel 110 is operated by a driving circuit or pixel circuit that generally includes a driving transistor and a light emitting device. Hereinafter the pixel 110 may refer to the pixel circuit. The light emitting device can optionally be an organic light emitting diode, but implementations of the present disclosure apply to pixel circuits having other electroluminescence devices, including current-driven light emitting devices and those listed above. The driving transistor in the pixel 110 can optionally be an n-type or p-type amorphous silicon thin-film transistor, but implementations of the present disclosure are not limited to pixel circuits having a particular polarity of transistor or only to pixel circuits having thin-film transistors. The pixel circuit 110 can also include a storage capacitor for storing programming information and allowing the pixel circuit 110 to drive the light emitting device after being addressed. Thus, the display panel 120 can be an active matrix display array.

As illustrated in FIG. 1, the pixel 110 illustrated as the top-left pixel in the display panel 120 is coupled to a select line 124, a supply line 126, a data line 122, and a monitor line 128. A read line may also be included for controlling connections to the monitor line. In one implementation, the supply voltage 114 can also provide a second supply line to the pixel 110. For example, each pixel can be coupled to a first supply line 126 charged with Vdd and a second supply line 127 coupled with Vss, and the pixel circuits 110 can be situated between the first and second supply lines to facilitate driving current between the two supply lines during an emission phase of the pixel circuit. It is to be understood that each of the pixels 110 in the pixel array of the display 120 is coupled to appropriate select lines, supply lines, data lines, and monitor lines. It is noted that aspects of the present disclosure apply to pixels having additional connections, such as connections to additional select lines, and to pixels having fewer connections.

With reference to the pixel 110 of the display panel 120, the select line 124 is provided by the address driver 108, and can be utilized to enable, for example, a programming operation of the pixel 110 by activating a switch or transistor to allow the data line 122 to program the pixel 110. The data line 122 conveys programming information from the data driver 104 to the pixel 110. For example, the data line 122 can be utilized to apply a programming voltage or a programming current to the pixel 110 in order to program the pixel 110 to emit a desired amount of luminance. The programming voltage (or programming current) supplied by the data driver 104 via the data line 122 is a voltage (or current) appropriate to cause the pixel 110 to emit light with a desired amount of luminance according to the digital data received by the controller 102. The programming voltage (or programming current) can be applied to the pixel 110 during a programming operation of the pixel 110 so as to charge a storage device within the pixel 110, such as a storage capacitor, thereby enabling the pixel 110 to emit light with the desired amount of luminance during an emission operation following the programming operation. For example, the storage device in the pixel 110 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 110, the driving current that is conveyed through the light emitting device by the driving transistor during the emission operation of the pixel 110 is a current that is supplied by the first supply line 126 and is drained to a second supply line 127. The first supply line 126 and the second supply line 127 are coupled to the voltage supply 114. The first supply line 126 can provide a positive supply voltage (e.g., the voltage commonly referred to in circuit design as "Vdd") and the second supply line 127 can provide a negative supply voltage (e.g., the voltage commonly referred to in circuit design as "Vss"). Implementations of the present disclosure can be realized where one or the other of the supply lines (e.g., the supply line 127) is fixed at a ground voltage or at another reference voltage.

The display system 150 also includes a monitoring system 112. With reference again to the pixel 110 of the display panel 120, the monitor line 128 connects the pixel 110 to the monitoring system 112. The monitoring system 12 can be integrated with the data driver 104, or can be a separate stand-alone system. In particular, the monitoring system 112 can optionally be implemented by monitoring the current and/or voltage of the data line 122 during a monitoring operation of the pixel 110, and the monitor line 128 can be entirely omitted. The monitor line 128 allows the monitoring system 112 to measure a current or voltage associated with the pixel 110 and thereby extract information indicative of a degradation or aging of the pixel 110 or indicative of a temperature of the pixel 110. In some embodiment, display panel 120 includes temperature sensing circuitry devoted to sensing temperature implemented in the pixels 110, while in other embodiments, the pixels 110 comprise circuitry which participates in both sensing temperature and driving the pixels. For example, the monitoring system 112 can extract, via the monitor line 128, a current flowing through the driving transistor within the pixel 110 and thereby determine, based on the measured current and based on the voltages applied to the driving transistor during the measurement, a threshold voltage of the driving transistor or a shift thereof.

The monitoring system 112 can also extract an operating voltage of the light emitting device (e.g., a voltage drop across the light emitting device while the light emitting device is operating to emit light). The monitoring system 112 can then communicate signals 132 to the controller 102 and/or the memory 106 to allow the display system 150 to store the extracted aging information in the memory 106. During subsequent programming and/or emission operations of the pixel 110, the aging information is retrieved from the memory 106 by the controller 102 via memory signals 136, and the controller 102 then compensates for the extracted degradation information in subsequent programming and/or emission operations of the pixel 110. For example, once the degradation information is extracted, the programming information conveyed to the pixel 110 via the data line 122 can be appropriately adjusted during a subsequent programming operation of the pixel 110 such that the pixel 110 emits light with a desired amount of luminance that is independent of the degradation of the pixel 110. In an example, an increase in the threshold voltage of the driving transistor within the pixel 110 can be compensated for by appropriately increasing the programming voltage applied to the pixel 110.

As described further below, for embodiments disclosed herein, calibration data is directly determined during an optical feedback calibration either during fabrication or after the display has been in operation for some time, from observing the luminance of each pixel and adjusting the calibration data to produce luminance of an acceptable level. In between periodic optical feedback calibrations, further monitoring as described above as the display ages may be utilized to adjust the compensation for continual aging and other phenomena which changes throughout the operating lifetime of the display.

Figure 2A:
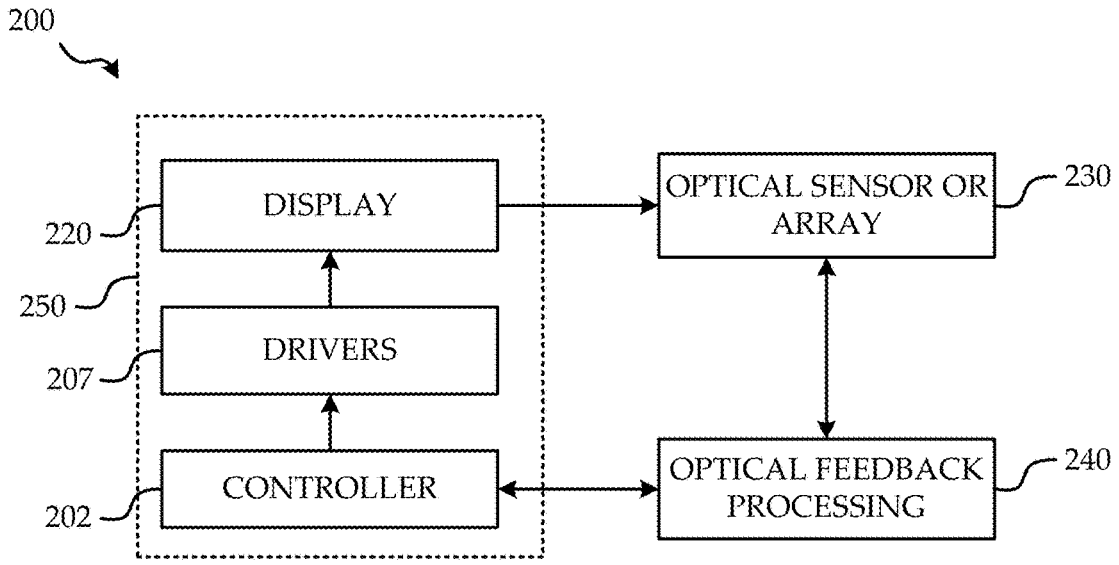
FIG. 2A is a system block diagram of an optical feedback system.

Referring to FIG. 2A, an optical feedback system 200 according to an embodiment will now be described.

The optical feedback system 200 includes display system 250 which is being calibrated an optical sensor or array 230, a controller 202 for overall control the process, which in embodiment in FIG. 2A is shown as part of the display system 250, and an optical feedback processing module 240 for controlling specific processes of the optical feedback methods. The optical feedback processing module 240 can be part of an external tool that used for example in a production factory for calibration of the displays. In another case, optical feedback processing 240 can be part of the display system and/or the controller, for example, integrated in a timing controller TCON. The display system 250 of FIG. 2A may correspond more or less to the display system 150 of FIG. 1 and includes similar components thereof, of which specifically, drivers 207, the display panel 220, and the controller 202 are shown explicitly for convenience. The controller 202 may correspond to controller 102 or controller 102 and memory 106 of FIG. 1.

The optical sensor or array 230 (hereafter "optical sensor") is arranged to measure the luminance of all of the pixels 110 of the display panel 220. The optical sensor 230 may be based on a digital photography system with or without lenses, optical scanning technology, or any other suitable optical measurement technology capable of taking optical measurements and/or generating a luminance measurement image representative of the optical output of the display panel 220. In some embodiments the optical feedback processing 240 generates the image from raw measurement data from the optical sensor 230 while in other embodiments it receives the image from the optical sensor 230. Luminance measurement image data refers to any two dimensional matrix containing optical luminance data corresponding to the output of the display panel 220, and may comprise multiple channels such as red (R), green (G), blue (B) etc. and in some cases may be monochromatic.

Figure 2B:
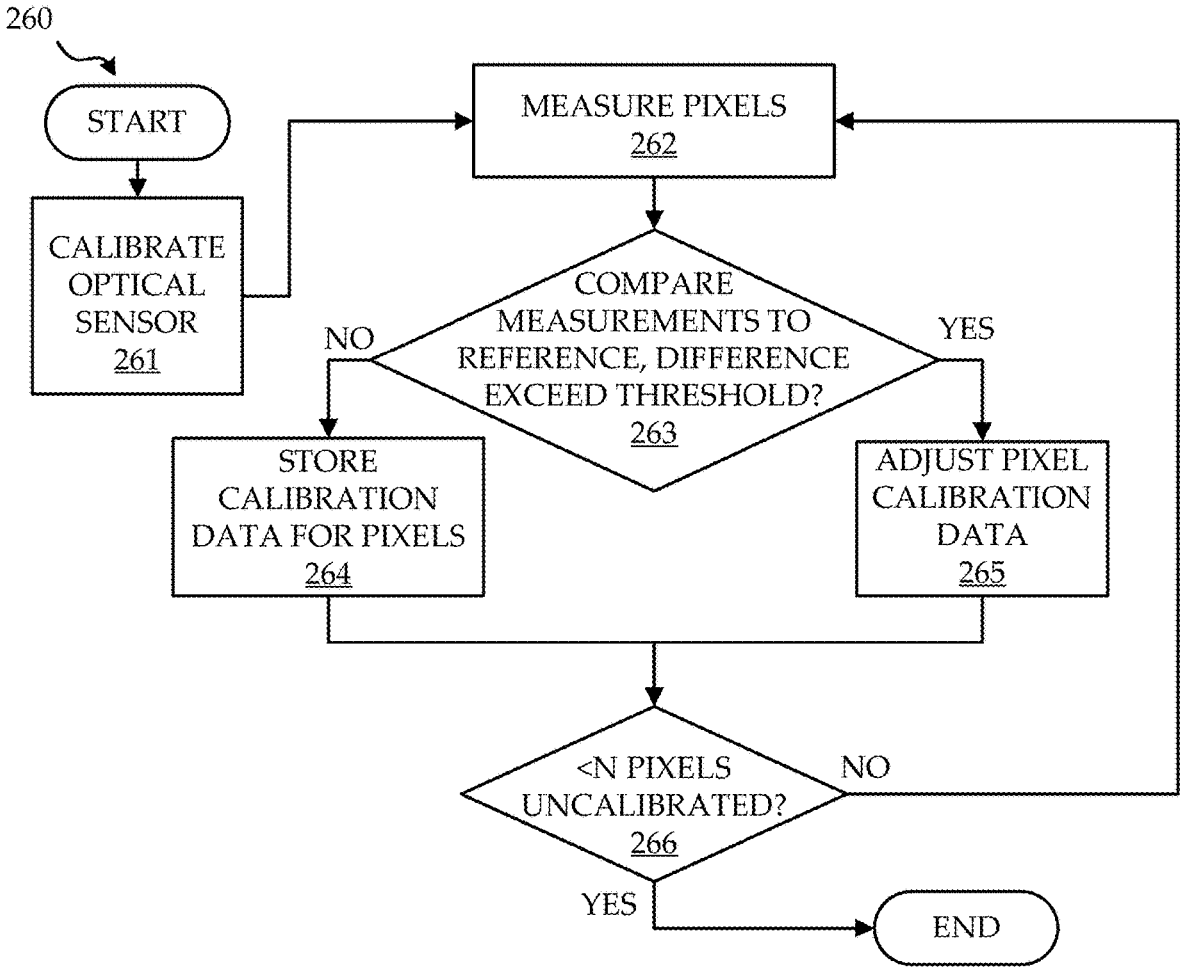
FIG. 2B is a high level functional block diagram of an optical feedback method.

With reference also to the optical feedback method 260 of FIG. 2B, prior to participation in the measurement of pixels in the optical feedback methods described herein, the optical sensor 230 is calibrated 261 to ensure accuracy of its measurements and/or to provide any sensor calibration data necessary for calibrating its output so that it may be rendered accurate. The optical sensor's 230 operation is generally controlled by the controller 202, as well as is the optical feedback processing 240.

After the optical sensor 230 measures the pixels 262, it provides the luminance measurement image data to optical feedback processing 240 which identifies the pixels in the display and extracts the luminance value of each pixel from the image. The luminance value of each pixel (or sub-pixel) is compared with a reference value 263 and if the difference does not exceed a threshold, the calibration data which was used to drive the pixel is stored as final calibration data. For each pixel which has a difference in luminance from the reference value which does exceed the threshold, calibration is deemed incomplete, and the optical feedback processing 240 adjusts the calibration data 265 for each pixel based on the measured data in a manner predicted to compensate for the difference, for retesting during another iteration of the calibration loop. Thereafter, the controller 202, which in the embodiment of FIG. 2A controls the entire process and the display 250, programs the display 250 with the new calibrated data and the process continues until the number of pixels deemed as remaining uncalibrated due to their difference in luminance from the reference values still exceeding the threshold, is less than a predefined threshold number of pixels N 266, which in some embodiments may be defined as a small percentage of the total number of pixels 110 in the display panel 220 or such that the process continues until all of the pixels have been processed.

In some embodiments, a process for identifying defective pixels 110 of the display panel 220 may be carried out for eliminating them from the rest of the calibration process of FIG. 2B. This process may be carried out at the beginning and outside of the calibration loop or may be carried out inside the calibration loop. If it is carried out outside of the calibration loop, relatively few measurements are performed to identify the pixels that do not respond to changes to the calibration data they are programmed with. While the output of working pixels change appropriately in response to changes in the calibration data used to program them, the output of defective pixels do not change enough or change too much in response to changing calibration data. Thus, if in response to being programmed with different calibration data, a pixel's output does not change, changes by an amount below a threshold minimum, or changes by an amount greater than a threshold maximum, the pixel is considered defective. If the defective pixels are identified inside the calibration loop, a defective pixel list is updated as the system identifies the pixels that do not respond to changes in the calibration data, i.e., the programming data they are programmed with.

Figure 3:
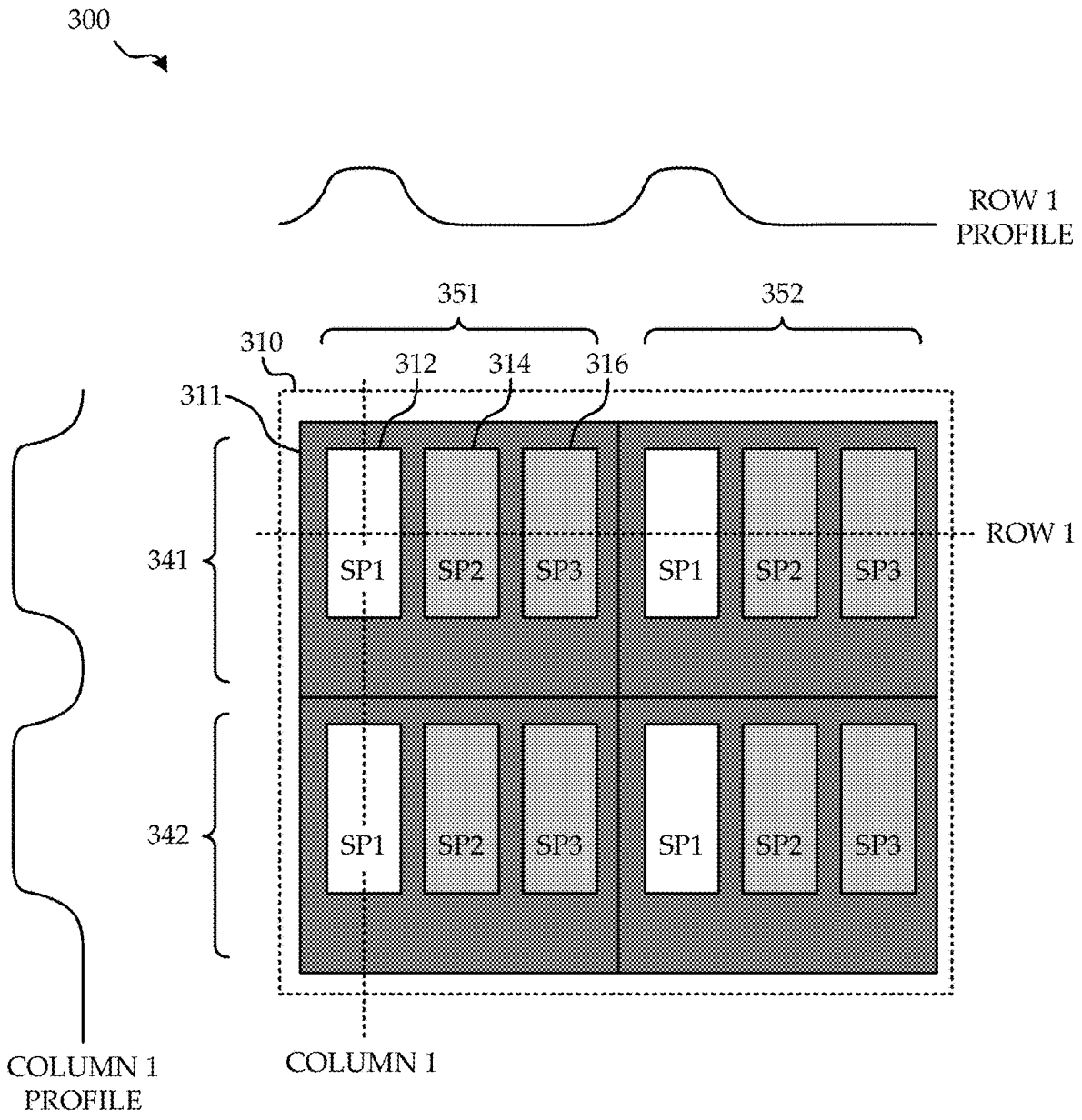
FIG. 3 illustrates pixel identification used in optical feedback according to one embodiment.

Referring to FIG. 3, pixel identification 300 used in optical feedback according to one embodiment will now be described.

To extract the luminance value of each display pixel 110, one can use a luminance profile of data from the luminance measurement image. The luminance profile corresponds to luminance data taken along a one dimensional line of the image and passing through the pixels (subpixels) of interest. FIG. 3 depicts pixels 311 (only four shown) of a display panel 310, arranged in rows 341, 342, and columns 351, 352, each pixel of which includes a first subpixel SP1 312, a second subpixel SP2 314, and a third subpixel SP3 316, each corresponding to a channel or color. Subpixels which are active are drawn in white, while subpixels which are inactive or displaying a "black" value are shown in grey. Two luminance profiles are shown for purposes of illustration. "Row 1 Profile" depicts luminance data along the line passing through Row 1 and all of the subpixels therein, which data reveals two active subpixels along that portion of row 1 separated by black space. "Column 1 Profile" depicts luminance data along the line passing through Column 1, but only though the first subpixel SP1 of each pixel of the column, which data reveals two active subpixels along that portion of column 1 separated by black space. Although the luminance profiles are shown as taken from specific lines passing through subpixels in the specific arrangement they are in in FIG. 3, it is to be understood that lines through the luminance measurement image data may be appropriately determined given any number and arrangement of subpixels in the pixels. In the embodiment of FIG. 3, each channel and their corresponding subpixels is measured separately, as can be seen by activation only of the first subpixels SP1 of each of the pixels of the display. This is suitable for monochromatic or color capable optical sensors. In other embodiments all channels i.e. subpixels are measured simultaneously by a color capable optical sensor 230 and some form of filtering or processing may be used to isolate subpixels by color if desired.

The luminance measurement image will have black areas between each pixel (sub-pixel) and the difference between the black area and the pixel can be used to identify the pixel areas. Locating the pixel positions within the luminance measurement data allow for proper determination of the luminance value (often corresponding to the value at or about the center of the subpixel) and identification of the particular pixel within the display panel to associate with that value. The luminance data profiles along lines through the active pixels are illustrative of this. The main challenges with this technique are that the edges are blurred and often for high resolution and/or high density displays the pixels (and subpixels) are too close.

Figure 4:
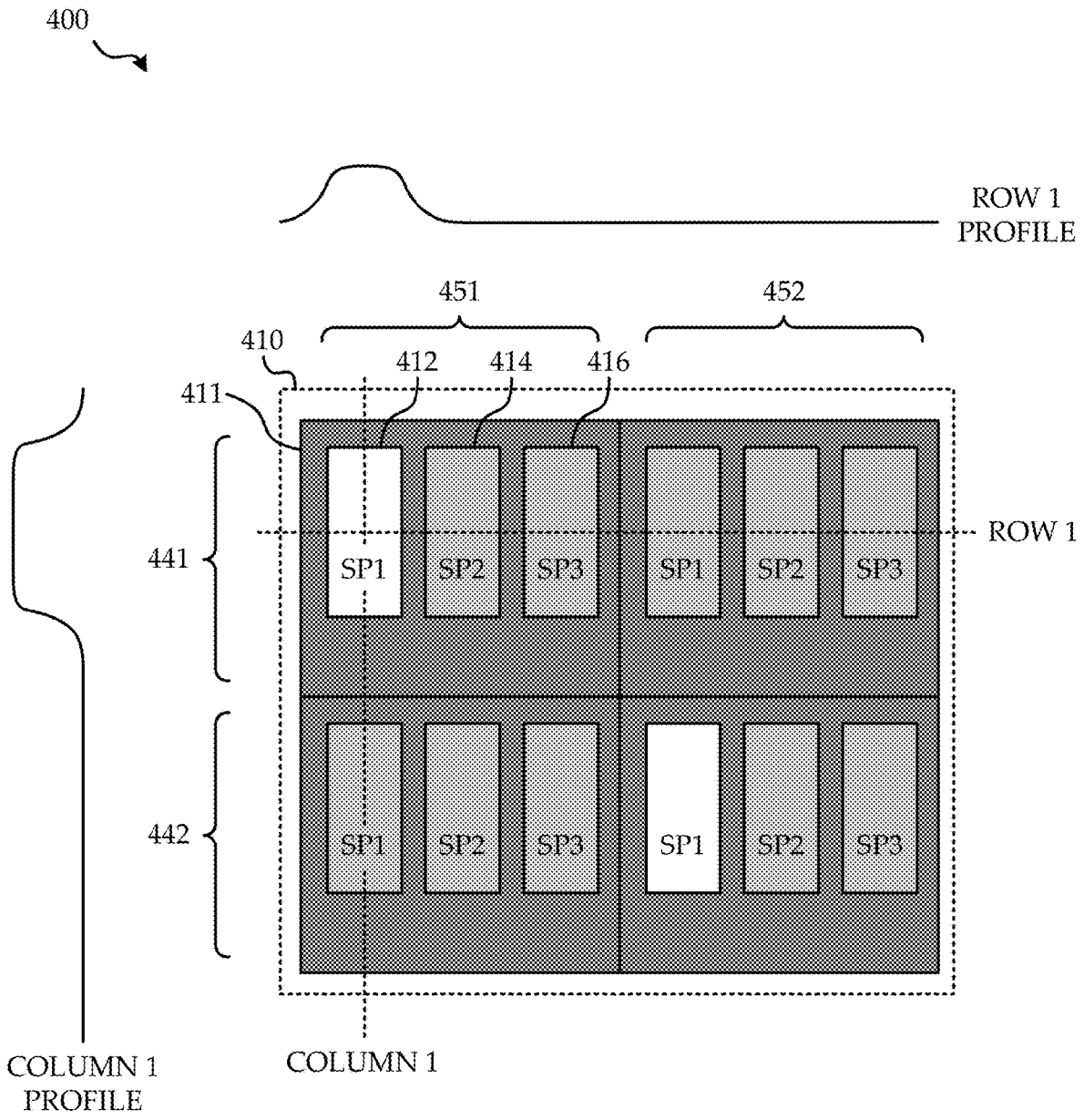
FIG. 4 illustrates pixel identification used in optical feedback according to an embodiment utilizing sparse activation.

Referring to FIG. 4, pixel identification 400 used in optical feedback according to an embodiment utilizing sparse activation will now be described. In cases where the black areas between adjacent pixels would be insufficient, activation of pixels during each calibration loop is performed with use of a subset of pixels, ensuring some pixels are off to provide the needed extra black spaces. Various sparse pixel activation patterns may be used including but not limited to a checkerboard pattern of alternatively on and off pixels as depicted in FIG. 4. Generally speaking, any sparse pattern which provides at least one inactive pixel between two active pixels whose luminances are being measured provides useful extra black area. Depending upon the density and resolution of the display more black area between pixels may be needed. Using a sparse pattern is particularly useful if the spatial resolution of the luminance measurement image producible by the optical sensor 230 is too low to properly resolve active subpixels sufficiently close to each other.

Although sparse pattern activation such as the checkerboard pattern of FIG. 4 makes identifying the pixels (subpixel) much easier, the calibration time will increase. Since only a subset of pixels is measured at any one time, the calibration loop needs to be repeated for different pixels at different times.

FIG. 4 depicts pixels 411 (only four shown) of a display panel 410, arranged in rows 441, 442, and columns 451, 452, each pixel of which includes a first subpixel SP1 412, a second subpixel SP2 414, and a third subpixel SP3 416, each corresponding to a channel or color. Subpixels which are active are drawn in white, while subpixels which are inactive or displaying a "black" value are shown in grey. Two luminance profiles are shown for purposes of illustration. "Row 1 Profile" depicts luminance data along the line passing through Row 1 and all of the subpixels therein, which data reveals only one active subpixel along that portion of row 1 followed by a black space. "Column 1 Profile" depicts luminance data along the line passing through Column 1, but only though the first subpixel SP1 of each pixel of the column, which data reveals only one subpixel along that portion of column 1 followed by a black space. As was the case for the embodiment depicted in FIG. 3, each channel and their corresponding subpixels is measured separately, as can be seen by activation only of the first subpixels SP1 of each of the pixels of the display.

Figure 5:
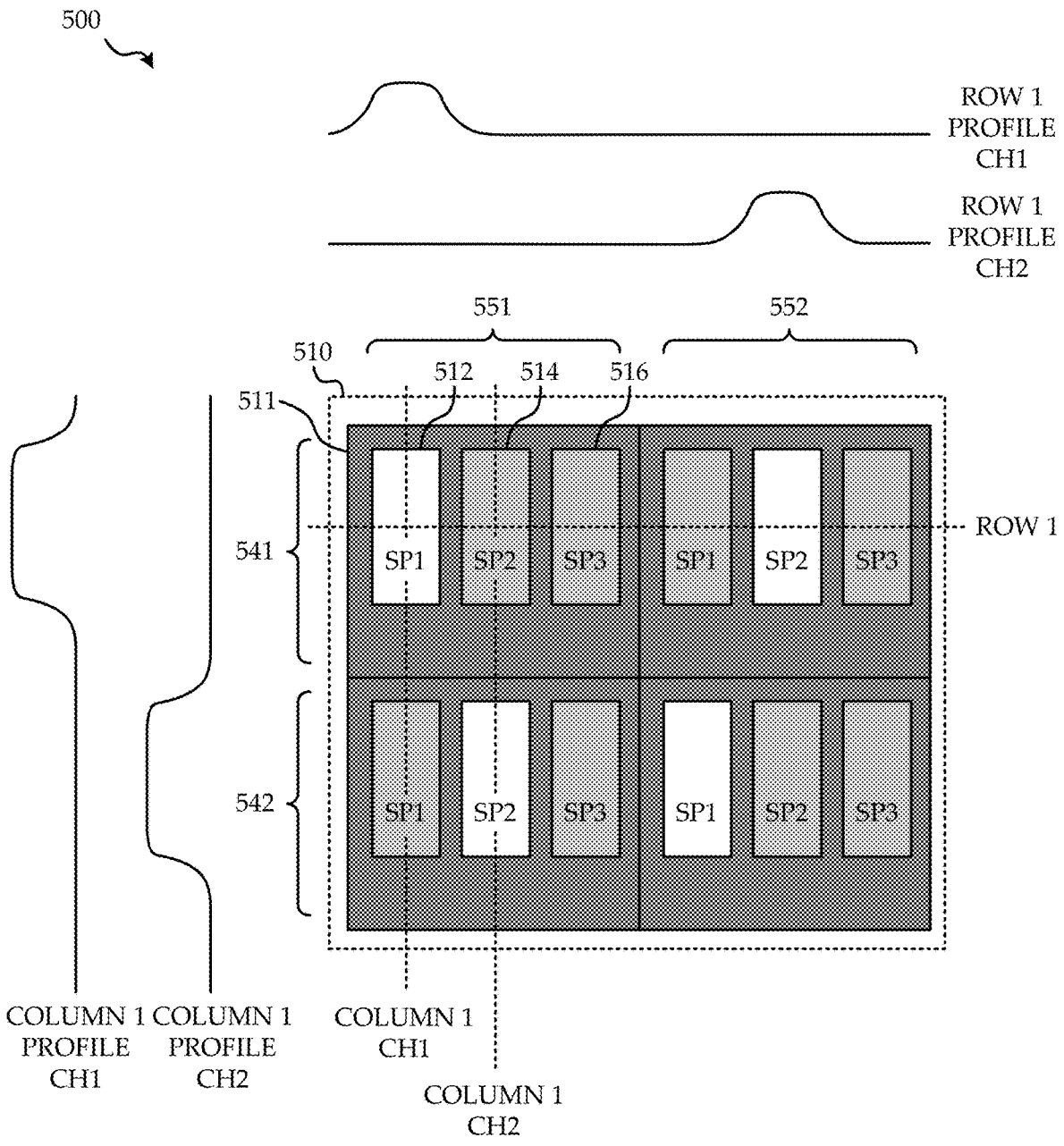
FIG. 5 illustrates pixel identification used in optical feedback according to an embodiment utilizing simultaneous sparse activation of multiple channels.

Referring to FIG. 5, pixel identification 500 used in optical feedback according to an embodiment utilizing simultaneous sparse activation of multiple channels will now be described. In cases where the black areas between adjacent pixels would be insufficient, activation of pixels during each calibration loop is performed with use of a subset of pixels, ensuring some pixels are off to provide the needed extra black spaces. As described above in connection with the embodiment of FIG. 4, calibration time increases when only a subset of pixels is measured at any one time. In order to mitigate this effect, multiple channels are measured (using a multichannel or color optical sensor 240) simultaneously. Sub-pixels of different channels are activated at the same time in sparse patterns. This increases the black area between the sub-pixels for each channel while enabling measurement of multiple types of sub-pixels in parallel.

As with the embodiment of FIG. 4, various sparse pixel activation patterns for each channel may be used including but not limited to a checkerboard pattern of alternatively on and off pixels as depicted in FIG. 5. Generally speaking, considerations for sparse patterns in simultaneous multichannel measurement are the same as considerations for single sparse patterns discussed in association with FIG. 4, but will depend upon the color and resolution capabilities of the optical sensor 230 and the resolution and density of the display panel. It should be understood that the sparse patterns employed by each channel simultaneously need not be the same and may be different from one another.

FIG. 5 depicts pixels 511 (only four shown) of a display panel 510, arranged in rows 541, 542, and columns 551, 552, each pixel of which includes a first subpixel SP1 512, a second subpixel SP2 514, and a third subpixel SP3 516, each corresponding to a channel or color. Subpixels which are active are drawn in white, while subpixels which are inactive or displaying a "black" value are shown in grey. Four luminance profiles are shown for purposes of illustration. "Row 1 Profile CH1" depicts luminance data for channel 1 (corresponding to the first subpixel SP1) along the line passing through Row 1 and all of the subpixels therein, which data reveals only one active subpixel of channel 1 (SP1) along that portion of row 1 followed by a black space. "Row 1 Profile CH2" depicts luminance data for channel 2 (corresponding to the first subpixel SP2) along the line passing through Row 1 and all of the subpixels therein, which data reveals only one active subpixel of channel 2 (corresponding to the second subpixel SP2) along that portion of row 1 preceded by a black space. "Column 1 Profile CH1" depicts luminance data for channel 1 (corresponding to SP1) along the line passing through Column 1, but only though the first subpixel SP1 of each pixel of the column, which data reveals only one active subpixel of channel 1 (SP1) along that portion of column 1 followed by a black space. "Column 1 Profile CH2" depicts luminance data for channel 2 (corresponding to SP2) along the line passing through Column 1, but only though the second subpixel SP2 of each pixel of the column, which data reveals only one active subpixel of channel 2 (SP2) along that portion of column 1 preceded by a black space. As opposed to the case for the embodiment depicted in FIG. 3, channels 1 and 2 and their corresponding subpixels are measured simultaneously, as can be seen by activation only of both first subpixels SP1 and second subpixels SP2 of the pixels of the display.

It should be understood that as part of the process of pixel identification of the embodiments described above, pixel positions for one sample (which can be a reference sample) can be identified and saved using a method as described above and then those positions may be used as a pixilation template for measuring other pixels or new samples. In this case, one may use an alignment step prior to taking the luminance measurement image. Here, showing some pattern in the panel along with the pictures can be used to align a stage upon which the optical sensor is mounted.

Figure 6:
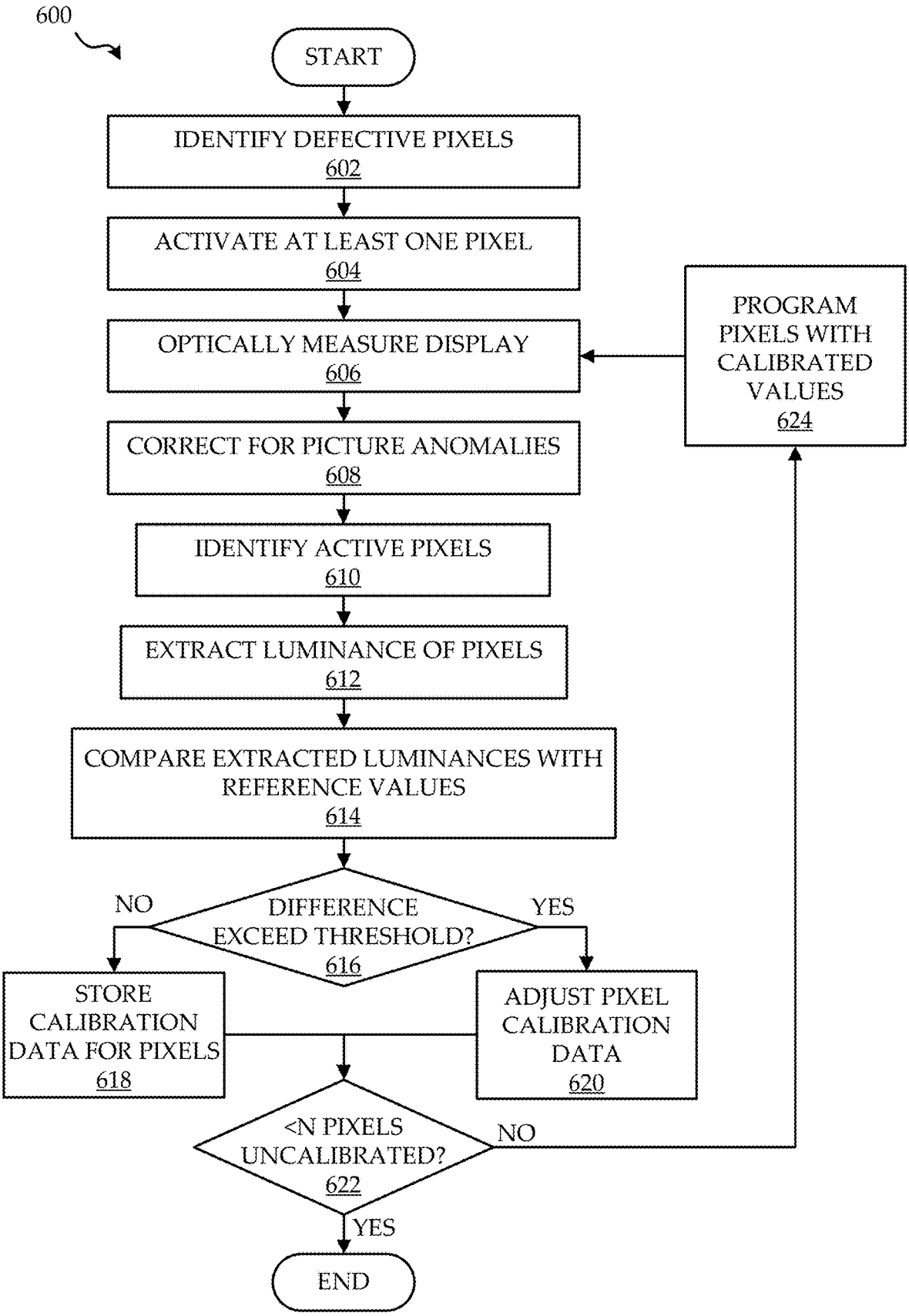
FIG. 6 illustrates a fine optical feedback data calibration method employed by the optical feedback system according to one embodiment.

Referring to FIG. 6, a fine optical feedback data calibration method 600 employed by the optical feedback system according to one embodiment will now be described.

Dead or defective pixels are identified first 602. As described in connection with FIG. 2B, relatively few measurements are performed to identify the pixels that do not respond to changes in calibration data. While the output of working pixels change appropriately in response to changes in the calibration data used to program them, the output of defective pixels do not change enough or change too much in response to changing calibration data. Thus, if in response to being programmed with different calibration data, a pixel's output does not change, changes by an amount below a threshold minimum, or changes by an amount greater than a threshold maximum, the pixel is considered defective. Then at least one pixel is activated 604, i.e. programmed with a value that is higher than black level. A picture or scan is made of the display 606 using the optical sensor, generating a luminance measurement image. As described above, the optical sensor and/or imager is calibrated prior to this step. The luminance measurement image is corrected for anomalies 608 such as the sensor calibration curve using, for example, the sensor calibration data generated during calibration of the optical sensor. This process is well known and can be performed with different methods. In one case, the output of the image sensor is remapped based on its calibration curves to reduce the error caused by non-linearity of the sensor. After anomaly correction, one or more of the methods of pixel identification mentioned above (or a different method) is used to identify the pixels (sub-pixels) 610. From the luminance measurement image and the luminance profiles, the luminance value of each pixel is extracted 612. These luminance values are compared with appropriate reference values 614. The reference value for a subpixel is determined based upon the level at which it is driven and may vary depending upon the type of subpixel, i.e., its particular channel or color, since the luminance produced by different types of subpixel vary and the luminance measurements produced by the optical sensor in each channel may vary. For each pixel, it is determined whether the luminance value is close enough to the reference value with use of a threshold. If the difference does not exceed the threshold 616, the luminance value is deemed close enough and the pixel calibrated, and the calibration data which was used to drive the pixel is stored as final calibration data 618. For each pixel which has a difference in luminance from the reference value which does exceed the threshold 616, calibration is deemed incomplete, and the calibration data is adjusted 620 for each pixel based on the measured data in a manner predicted to compensate for the difference, for retesting during another iteration of the calibration loop. The calibration data is based on the measured pixel luminance value and the previous pixel programming value.

If the number of the pixels deemed as remaining uncalibrated due to their difference in luminance from the reference values still exceeding the threshold, is less than a predefined threshold number of pixels N 622, the process stops. In some embodiments the defective pixels are not counted as uncalibrated and are ignored in this evaluation, and N is set to ensure the process continues until most of the pixels of the display panel are close to the reference value. If the number of the pixels deemed as remaining uncalibrated due to their difference in luminance from the reference values still exceeding the threshold, is not less than N 622, the process continues and each pixel is programmed using the calibration data 624. The feedback loop then continues with a further iteration starting with optical measurement of the display 606. If sparse activation of pixels is used, periodically a different set of pixels will be activated prior to optically measuring the display 606.

Figure 7:
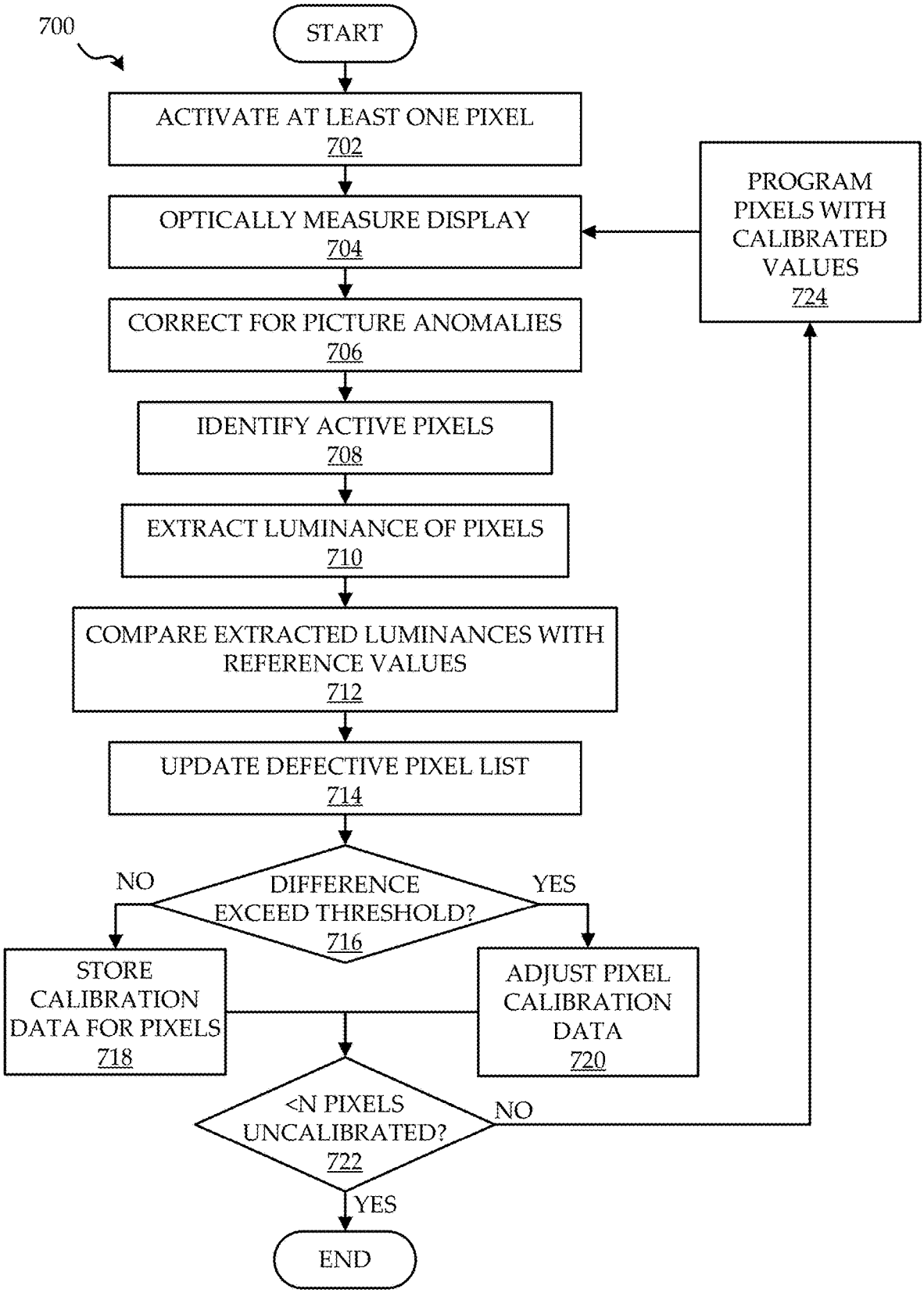
FIG. 7 illustrates a fine optical feedback data calibration method employed by the optical feedback system according to a second embodiment.

Referring to FIG. 7, a second fine optical feedback data calibration method 700 employed by the optical feedback system according to an embodiment will now be described.

For this method, dead pixels are identified within the feedback loop as described below. The method starts with activation of at least one pixel 702, i.e., the pixels are programmed with values higher than black level. A picture or scan is made of the display 704 using the optical sensor, generating a luminance measurement image. As described above, the optical sensor or array is calibrated prior to this step. The luminance measurement image is corrected for anomalies 706 such as the sensor calibration curve as discussed above. After anomaly correction, one or more of the methods of pixel identification mentioned above (or a different method) is used to identify the pixels (sub-pixels) 708. From the luminance measurement image and the luminance profiles, the luminance value of each pixel is extracted 710. These luminance values are compared with appropriate reference values 712 for each pixel. The reference value for a subpixel is determined based upon the level at which it is driven and may vary depending upon the type of subpixel, i.e. its particular channel or color, since the luminance produced by different types of subpixel vary and the luminance measurements produced by the optical sensor in each channel may vary. The response to the programming voltage in the feedback loop is used to identify the defective pixels and the defective pixel list is updated 714. As described in connection with FIG. 2B, pixels are deemed defective when they do not respond to changing calibration data which means they are not responding to changes in programming voltage.

For each pixel which is not defective, it is determined whether the luminance value is close enough to the reference value with use of a threshold. If the difference does not exceed a threshold 716, the luminance value is deemed close enough and the pixel calibrated, and the calibration data which was used to drive the pixel is stored as final calibration data 718. For each pixel which has a difference in luminance from the reference value which does exceed the threshold 716, calibration is deemed incomplete, and the calibration data is adjusted 720 for each pixel based on the measured data in a manner predicted to compensate for the difference, for retesting during another iteration of the calibration loop. The calibration data is based on the measured pixel luminance value and the previous pixel programming value.

If the number of the pixels deemed as remaining uncalibrated due to their difference in luminance from the reference values still exceeding the threshold, is less than a predefined threshold number of pixels N 722, the process stops. The defective pixels of the defective pixel list are ignored in this evaluation. If the number of the pixels deemed as remaining uncalibrated due to their difference in luminance from the reference values still exceeding the threshold, is not less than N 722, the process continues and each pixel is programmed using the calibration data 724. The feedback loop then continues with a further iteration starting with optical measurement of the display 704. If sparse activation of pixels is used, periodically a different set of pixels will be activated prior to optically measuring the display 704.

Although the embodiments of FIG. 6 and FIG. 7 each illustrate a specific method of identifying defective pixels it should be understood that a combination of these techniques may be utilized. Moreover, with respect to the embodiment illustrated in FIG. 7, it should be understood that identifying the defective pixels and updating the defective pixel list 714 may be carried out in different places in the feedback loop.

Figure 8:
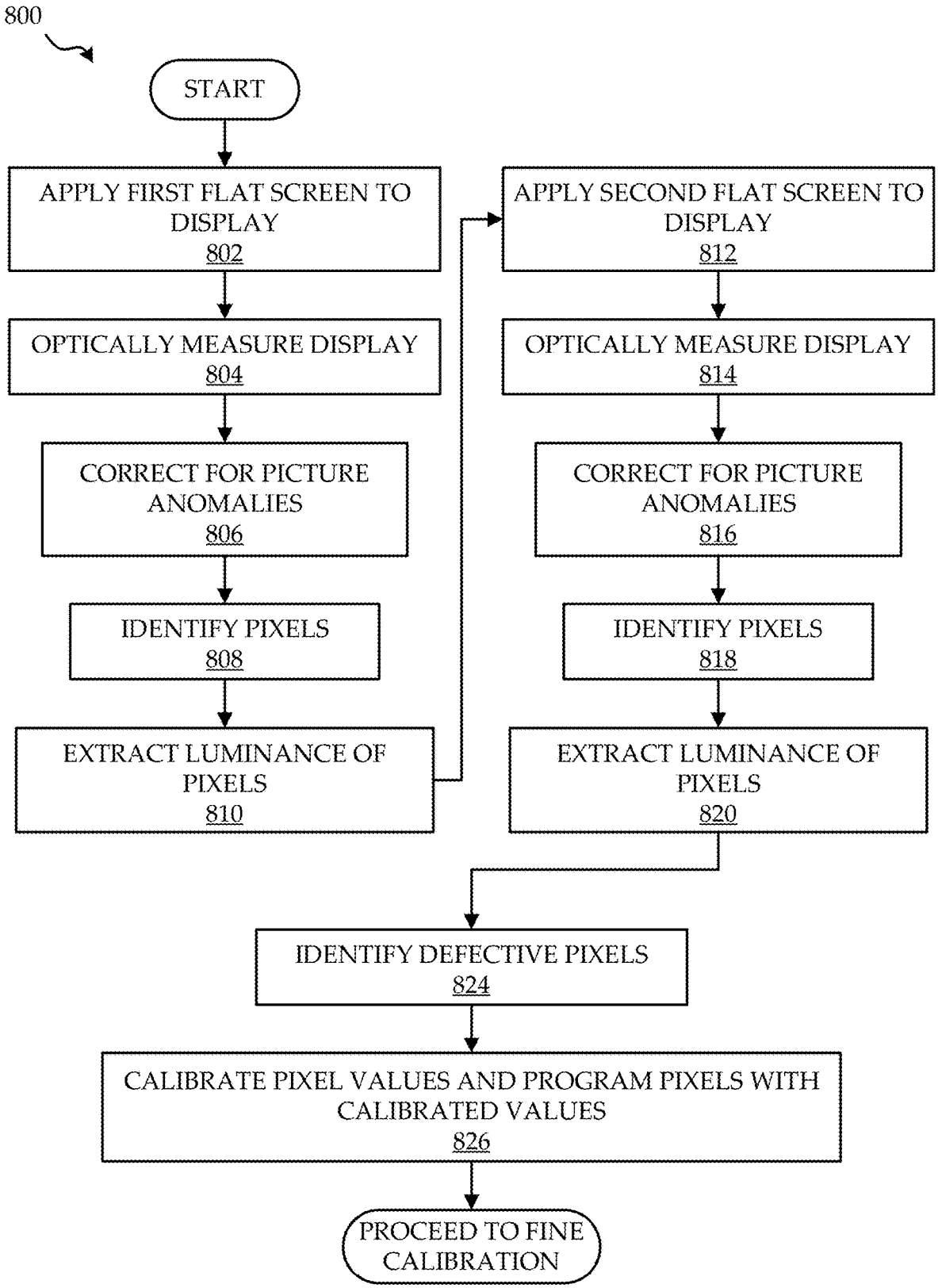
FIG. 8 illustrates a coarse optical feedback data calibration method employed by the optical feedback system according to a further embodiment.

Referring to FIG. 8, a coarse optical feedback data calibration method 800 employed by the optical feedback system according to a further embodiment will now be discussed.

The embodiment of FIG. 8, is a method to accelerate the calibration of the pixel programming value by employing a coarse calibration 800 prior to a fine calibration such as those of the embodiments described in association with FIG. 6 and FIG. 7 or another method of fine calibration.

During coarse calibration 800, two (or more) pictures of the pixels programmed with different values during each picture are taken 802, 812. From the pictures i.e., the luminance measurement images, a coarse input-output characteristic having as many points as measurements per pixel (number of pictures) taken, is extracted for each pixel. Then, a programming value for the intended pixels for calibration is calculated based on the in-out characteristic and a given reference output value 826. As a last step prior to completion of coarse calibration 800, the display panel is initialized i.e., programmed 826 with this calibration data prior to commencement of the fine calibration methods of FIG. 6 or FIG. 7.

In an example embodiment utilizing two programming values, coarse calibration 800 commences with applying a flat screen to the display i.e. applying one luminance value to all the pixels of the display 802. In a similar manner to that described above the display panel displaying the first flat screen is optically measured 804, the luminance measurement image is corrected for anomalies 806, pixels are identified 808, and luminance values for the pixels are extracted. After all luminance values corresponding to the display of the first flat screen are extracted, a second flat screen is applied to the display, i.e. a different luminance value is applied to all the pixels of the display 812. Again, in a similar manner to that described above the display panel displaying the second flat screen is optically measured 814, the luminance measurement image is corrected for anomalies 816, pixels are identified 818, and luminance values for the pixels are extracted. After all luminance values corresponding to the display of the second flat screen are extracted, defective pixels are identified 824 as those pixels which were unresponsive to changes in the programming voltages i.e. unresponsive to the change from being driven by the first and then by the second flat screen luminance value. From the two luminance measurements for each pixel, a coarse input-output characteristic having two data points is extracted for each pixel and a programming value for the intended pixels for calibration is calculated based on the in-out characteristic and a given reference output value 826. In the last step prior to completion of coarse calibration 800, the display panel is initialized i.e., programmed 826 with this calibration data prior to commencement of the fine calibration methods of FIG. 6 or FIG. 7 or another method of fine calibration.

The coarse curve determined from the coarse calibration method 800 may also be utilized in the fine calibration methods of the embodiments described in association with FIG. 6 and FIG. 7 to find the amount of or the direction of the fine tuning in the feedback loop during adjustment of the pixel calibration data 620, 720. Having a coarse measurement of the actual input-output curve addresses the significant different propagation error which otherwise could occur for a display having high non-uniformity. Coarse calibration 800 can also be used to identify the defective pixels prior to the fine calibration methods of the embodiments described in association with FIG. 6 and FIG. 7, and may be used to replace or supplement the defective pixel detection 602, 714 of those embodiments.

It should be understood that in some embodiments the different methods described hereinabove may be combined to optimize the speed and performance of the calibration. In other embodiments achieving the same overall calibration process, the order of the specific steps of the calibration processes above are rearranged. Other embodiments which are combinations of any of the aforementioned embodiments are contemplated and the embodiments described herein are generally applicable to pixels having any subpixel combination and arrangement e.g. RGBW, RGBG, etc.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of an invention as defined in the appended claims.

What is claimed is:

1. An optical feedback method for calibrating an emissive display system having pixels, each pixel having a light-emitting device, the method comprising:

iteratively performing a calibration loop until a number of pixels of the display determined to be uncalibrated is less than a threshold number of pixels, the calibration loop comprising:

measuring the luminance of pixels of the display generating luminance measurements for each pixel;

comparing luminance measurements for the pixels with reference values generating a comparison value for each pixel measured;

determining for each pixel whether the pixel is calibrated or uncalibrated based on the comparison value for the pixel;

adjusting calibration data for each pixel determined to be uncalibrated with use of the luminance measurement for the pixel and previous calibration data for the pixel; and programming each pixel whose calibration data was adjusted with the adjusted calibration data.

2. The method of claim 1, wherein the comparison value comprises a difference value.

3. The method of claim 2, further comprising:

storing currently used calibration data for each pixel determined to be calibrated as final calibration data for the pixel, wherein said determining for each pixel whether the pixel is calibrated or uncalibrated based on the comparison value for the pixel comprises:

determining for each pixel whether the difference value exceeds a difference threshold, and for pixels having a difference value which does not exceed the difference threshold determining the pixel to be calibrated and for pixels having a difference value which exceeds the difference threshold determining the pixel to be uncalibrated.

4. The method of claim 1 wherein measuring the luminance of pixels of the display comprises identifying the pixels of the display comprising:

activating at least one pixel of the display for luminance measurement;

generating a luminance measurement image of the pixels of the display after activating the at least one pixel;

identifying pixels of the display from the variation in luminance in the luminance measurement image; and extracting luminance data for each pixel identified at a position within the luminance measurement image with use of the luminance data along at least one luminance profile passing through the position within the luminance measurement image to generate said luminance measurement for said pixel.

5. The method of claim 4 wherein activating the at least one pixel of the display comprises activating a sparse pixel pattern wherein between any two pixels activated for luminance measurement there is at least on pixel which is inactive, thereby providing luminance measurement data corresponding to a black area between the two pixels along the at least one luminance profile.

6. The method of claim 5 further comprising:

prior to iteratively performing the calibration loop:

programming each of the pixels of the display with at least two unique values;

measuring the luminance of the pixels corresponding to each programmed unique value, generating coarse input-output characteristics for each pixel;

generating calibration data for each pixel based on the coarse input-output characteristics for each pixel; and programming each of the pixels of the display with the calibration data for the pixel.

7. The method of claim 6 further comprising:

identifying defective pixels unresponsive to changes in calibration data for the defective pixels;

correcting the luminance measurement image after generated for anomalies; and calibrating an optical sensor used for measuring the luminance of pixels of the display prior to measuring the luminance of pixels of the display.

8. The method of claim 4 wherein activating the number of pixels of the display comprises activating a multichannel sparse pixel pattern wherein more than one channel of pixels is activated simultaneously and between any two pixels activated of any channel for luminance measurement there is at least one pixel of that channel which is inactive, thereby providing a luminance measurement data corresponding to a black area of that channel between the two pixels along the at least one luminance profile.

9. The method of claim 4, further comprising:

identifying defective pixels unresponsive to changes in calibration data for the defective pixels;

correcting the luminance measurement image after generated for anomalies; and calibrating an optical sensor used for measuring the luminance of pixels of the display prior to measuring the luminance of pixels of the display.

10. The method of claim 1 further comprising:

prior to iteratively performing the calibration loop:

programming each of the pixels of the display with at least two unique values;

measuring the luminance of the pixels corresponding to each programmed unique value, generating coarse input-output characteristics for each pixel;

generating calibration data for each pixel based on the coarse input-output characteristics for each pixel; and programming each of the pixels of the display with the calibration data for the pixel.

11. An optical feedback system for calibrating an emissive display system having pixels, each pixel having a light-emitting device, the system comprising:

a display panel comprising said pixels;

an optical sensor operative to measure luminance of pixels of the display panel;

optical feedback processing coupled to the optical sensor; and a controller of the emissive display system coupled to said optical feedback processing and configured for iteratively controlling a calibration loop until a number of pixels of the display panel determined to be uncalibrated is less than a threshold number of pixels, iteratively controlling the calibration loop comprising:

controlling the optical sensor and the optical feedback processing to measure the luminance of pixels of the display panel generating luminance measurements for each pixel;

controlling the optical feedback processing to compare luminance measurements for the pixels with reference values generating a comparison value for each pixel measured;

controlling the optical feedback processing to determine for each pixel whether the pixel is calibrated or uncalibrated based on the comparison value for the pixel;

adjusting the calibration data for each pixel determined to be uncalibrated with use of the luminance measurement for the pixel and previous calibration data for the pixel; and programming each pixel whose calibration data was adjusted with the adjusted calibration data.

12. The system of claim 11, wherein the comparison value comprises a difference value.

13. The system of claim 12, wherein said controller is further configured for:

storing currently used calibration data for each pixel determined to be calibrated as final calibration data for the pixel, wherein said optical feedback processing's determining for each pixel whether the pixel is calibrated or uncalibrated based on the comparison value for the pixel comprises:

determining for each pixel whether the difference value exceeds a difference threshold, and for pixels having a difference value which does not exceed the difference threshold determining the pixel to be calibrated and for pixels having a difference value which exceeds the difference threshold determining the pixel to be uncalibrated.

14. The system of claim 11 wherein the controller's controlling of the optical sensor and the optical feedback processing to measure the luminance of pixels of the display panel comprises controlling identification of the pixels of the display panel comprising:

activating at least one pixel of the display panel for luminance measurement;

controlling the optical sensor and optical feedback processing to generate a luminance measurement image of the pixels of the display panel after activating the at least one pixel;

controlling the optical feedback processing to identify pixels of the display panel from the variation in luminance in the luminance measurement image; and controlling the optical feedback processing to extract luminance data for each pixel identified at a position within the luminance measurement image with use of the luminance data along at least one luminance profile passing through the position within the luminance measurement image to generate said luminance measurement for said pixel.

15. The system of claim 14 wherein the controller's activating the at least one pixel of the display comprises activating a sparse pixel pattern wherein between any two pixels activated for luminance measurement there is at least on pixel which is inactive, thereby providing luminance measurement data corresponding to a black area between the two pixels along the at least one luminance profile.

16. The system of claim 15, wherein the controller is further for prior to iteratively performing the calibration loop:

programming each of the pixels of the display with at least two unique values;

controlling the optical sensor and the optical feedback processing to measure the luminance of the pixels corresponding to each programmed unique value, to generate coarse input-output characteristics for each pixel;

generating calibration data for each pixel based on the coarse input-output characteristics for each pixel; and programming each of the pixels of the display with the calibration data for the pixel.

17. The system of claim 16, wherein the optical sensor is calibrated prior being used for measuring the luminance of pixels of the display, and wherein the controller is further for:

controlling the optical feedback processing to identify defective pixels unresponsive to changes in calibration data for the defective pixels; and controlling the optical feedback processing to correct for anomalies the luminance measurement image after generated.

18. The system of claim 14 wherein the controller's activating the number of pixels of the display comprises activating a multichannel sparse pixel pattern wherein more than one channel of pixels is activated simultaneously and between any two pixels activated of any channel for luminance measurement there is at least one pixel of that channel which is inactive, thereby providing a luminance measurement data corresponding to a black area of that channel between the two pixels along the at least one luminance profile.

19. The system of claim 14, wherein the optical sensor is calibrated prior being used for measuring the luminance of pixels of the display, and wherein the controller is further for:

controlling the optical feedback processing to identify defective pixels unresponsive to changes in calibration data for the defective pixels; and controlling the optical feedback processing to correct the luminance measurement image after generated for anomalies.

20. The system of claim 11, wherein the controller is further for prior to iteratively performing the calibration loop:

programming each of the pixels of the display with at least two unique values;

controlling the optical sensor and the optical feedback processing to measure the luminance of the pixels corresponding to each programmed unique value, to generate coarse input-output characteristics for each pixel;

generating calibration data for each pixel based on the coarse input-output characteristics for each pixel; and programming each of the pixels of the display with the calibration data for the pixel.

* * * * *